US006012973A

United States Patent [19]

Nagel

[11] Patent Number: 6,012,973

[45] Date of Patent: Jan. 11, 2000

[54] CYLINDER AND METHOD FOR HONING ITS INTERNAL SURFACES

[75] Inventor: Wolf Nagel, Nuertingen, Germany

[73] Assignee: Nagel-Maschinen-und Werkzeugfabrik GmbH, Germany

[21] Appl. No.: 09/001,053

[22] Filed: Dec. 30, 1997

[51] Int. Cl.[7] ..... B24B 1/00

[52] U.S. Cl. ..... 451/51; 451/61; 451/27

[58] Field of Search ..... 451/51, 57, 61, 451/27, 155

[56] References Cited

FOREIGN PATENT DOCUMENTS

| | | |
|---|---|---|
| 29 31 997 A1 | 1/1981 | Germany . |
| 37 35 266 A1 | 4/1989 | Germany . |
| 42 26 335 A1 | 2/1994 | Germany . |
| 43 16 012 A1 | 11/1994 | Germany . |

*Primary Examiner*—David A. Scherbel
*Assistant Examiner*—Dung Van Nguyen
*Attorney, Agent, or Firm*—Quarles & Brady

[57] ABSTRACT

When honing working cylinders for reciprocating piston-type machines or engines, e.g. internal combustion engines, unlike in conventional honing methods working takes place with a much higher axial speed than circumferential speed. This gives a mark pattern, which admittedly differs significantly from the axial direction, but runs more in the axial direction than in the circumferential direction. On the dominant mark pattern can be superimposed in a finishing operation a honing mark pattern, which has much finer honing marks and creates a plateau surface with diamond-shaped islands pointing in the working direction of the piston. A thus treated working cylinder, in the case of limited wear, leads to much lower oil consumption on the part of the engines.

7 Claims, 1 Drawing Sheet

CYLINDER AND METHOD FOR HONING ITS INTERNAL SURFACES

The invention relates to a method for honing cylinder internal surfaces, particularly of reciprocating piston-type engines, motors and machines, as well as a cylinder, particularly a working cylinder of such machines.

Cylinders of such engines and machines, particularly of internal combustion engines, are conventionally internally honed, in order to obtain a dimensionally stable, cylindrical hole shape and a good oil-holding surface subject to low wear for the piston running therein and its rings.

Honing takes place by machining with a rotary and an axial component of motion of a honing tool, but normally the circumferential component of the movement dominates. Therefore the crossing or intersection angles of the machining marks are such that they give an angle of more than 45° to the axial direction. During prehoning the angle corresponding to a crossing angle of 90° is chosen, whereas during posthoning or finish honing the crossing angle is chosen in such a way that the angle to the axial direction is 70 to 75° (crossing angle 30 to 40°). This corresponds to a ratio of the axial component to the circumferential component of the machining movement of 0.2:1 to 1:1.

Through the crossing machining marks honed cylinder bores were considered advantageous due to their oil holding property.

U.S. Pat. No. 5,655,955 discloses exclusively axially honing such working cylinders. However, an extremely small divergence from the axial direction is considered possible. Thus, the honing marks in the axial direction must ensure that the components cooperating with the cylinder inner surface during the operation of a machine or engine, i.e. the pistons and piston rings assume a microshape corresponding to the axially honed surface. Thus, the parts cooperating with one another are trued to one another. This is only possible with axially directed honing marks.

OBJECT OF THE INVENTION

An object of the invention is to provide a method for honing cylinder internal surfaces and such a cylinder, which in conjunction with the components running therein has a limited friction action for a low lubricating oil consumption and a long life, i.e. low wear.

SUMMARY OF THE INVENTION

It has surprisingly been found that honing with a high axial component of the machining movement, i.e. a ratio of the axial component to the circumferential component in the range between 1.5:1 and 10:1, both compared with normal honing with an axial component between 0.2:1 and 1:1 and compared with pure axial honing with a theoretically infinitely large axial to circumferential component ratio or a ratio well above 10:1 leads to amazing advantages. This could not have been expected, because here apparently the advantages of both known principles are abandoned, namely the "oil holding channels" running preponderantly in the transverse direction of conventionally honed surfaces and the automatic grinding in action during axial honing. Particularly with the preferred axial/circumferential ratio between 2:1 and 5:1, preferably at 4:1, there is an angle with respect to the axial direction of about 12° to just 30°, so that between the honing marks are obtained diamond-shaped or rhombic fields or "islands" with their tip pointing in the axial direction. They can be so machined during a subsequent honing process with a normal axial component, i.e. a dominant circumferential movement, and with particularly fine cutting compounds, that they form a "plateau" having a core peak-to-valley height or roughness of less than 1 $\mu$m $R_K$, preferably less than 0.5 $\mu$m $R_K$. The core peak-to-valley height is a peak-to-valley value to be determined from the Abbott curve (cf. DIN 4776).

The honing marks of the machining according to the invention admittedly have a pronounced inclination, but which does not exceed approximately 30° with respect to the axial direction, i.e. the movement direction of the piston in the cylinder, and can be referred to as helical honing marks. Tests carried out on internal combustion engines have revealed that as a result of this machining of the cylinder the oil consumption could be dramatically reduced. This more particularly applies under extreme load states. The significance of the lower oil consumption in view of the reduction in consumption of mineral oil products and particularly for lower pollutant emissions is considerable, particularly because it is simultaneously associated with lower frictional resistances and therefore also a reduction of fuel consumption. Finally, the low wear obtained leads to longer service life periods for engines, as well as a higher loadability of smaller engines, which also reduces the overall consumption. The same has been found with other reciprocating engines, e.g. compressors, in which the lower oil enrichment in compressed gas is particularly advantageous.

These surprising improvements are also difficult to explain for the expert. They could be due to the fact that from the grooves running more in the axial direction compared with normal honing, the oil, which can be well retained there, can be more easily distributed on the cylinder surface, but can simultaneously be well scraped off again by the oil scraper rings of the piston, so that less of it passes into the combustion chamber. The helical honing marks could also assist a desired rotary movement of the piston rings, which consequently do not, as is sought with pure axial honing, always remain in a fixed circumferential position, but instead rotate on the piston in order to remain mobile. This could be helped by the fact that the crossing honing marks are somewhat asymmetrical with respect to the axial direction, i.e. the angle in one direction is higher than in the other. This would give the piston rings a preferred movement in one direction, particularly as in certain circumstances they are subject to varying loading during the upward and downward movement. This could be achieved by a different axial speed for the upward and downward movement of the honing tool.

The honing machining according to the invention, compared with pure axial honing, allows a better roundness and uniformity of the honing and therefore an improved macrogeometry of the surface, together with shorter honing times due to the greater material removal made possible by the crossing machining marks.

These and further features can be gathered from the claims, description and drawings and the individual features, both singly or in the form of subcombinations, can be implemented in an embodiment of the invention and in other fields and can represent advantageous, independently protectable constructions for which protection is hereby claimed.

The subdivision of the application into individual sections and the subtitles in no way limit the general applicability of the statements made thereunder.

BRIEF DESCRIPTION OF THE DRAWINGS

An embodiment of the invention is described in greater detail hereinafter relative to the attached drawings, wherein show.

DESCRIPTION OF AN EMBODIMENT

The honing method is performed by means of a normal honing tool 20, which is e.g. constructed as a segmental tool or as a ledge tool with relatively closely juxtaposed ledges. A segmental tool has relatively large-area segments 21 with a cutting facing, which are in conventional manner mounted in a widenable manner in a tool body, whereas a ledge tool has relatively narrow honing ledges. They can either contain the cutting compound themselves, e.g. in a ceramic or plastic bond or the cutting facing can be applied in the form of a coating. It is also possible to use high-grade cutting coatings of synthetic diamond or cubic, crystalline boron nitride.

Figure 1:
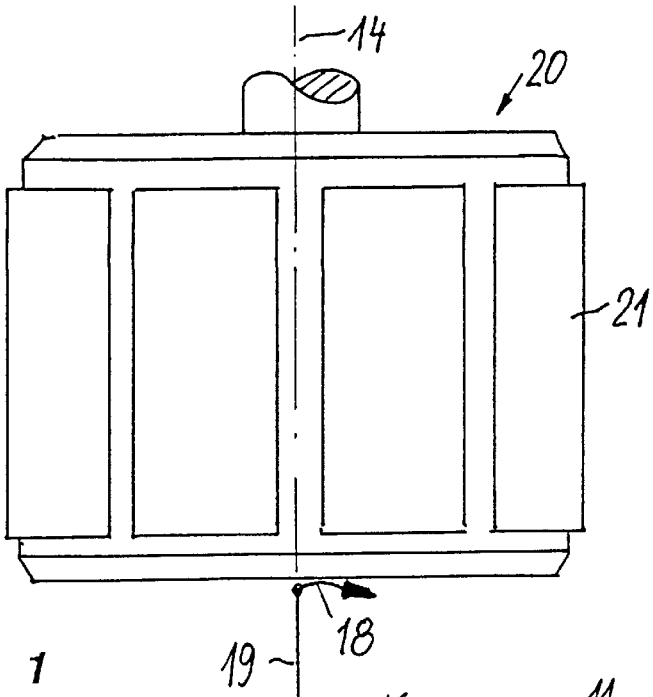
FIG. 1 A diagrammatic view of a honing tool and a working cylinder section worked therewith and the honing marks thereon.

For carrying out the honing operation the tool is driven both in a rotary and in an axially reciprocating manner and passes over the inner surface 11 of a cylinder 12 to be honed by a predetermined amount, e.g. by one third of its length. According to the invention the axial speed component 19 of the reciprocating movement is somewhat larger than the circumferential speed component 18 of the machining movement. The ratio is between 1.5:1 and 10:1, i.e. in the case of a relatively slow rotation of the honing tool working takes place with a high axial component of the speed, but the resultant speed is in the normal honing speed range, i.e. between 15 and 40 m/min. In the embodiment shown in FIG. 1 working took place with an axial to circumferential speed ratio of 4:1, which gives an angle of the honing marks 13, present on the internal surface 11, of said helical honing to the cylinder axis 14 of alpha=approximately 15°.

In helical honing with increased axial component working takes place with a cutting compound permitting a good material removal, e.g. with a diamond honing facing or coating with a grain size D30 to D80 (grain diameter between 30 and 80 $\mu$m). On a prehoned surface, this working gives a surface with a good bore or hole geometry (roundness, straightness, limited waviness) and not too deep, but clear, crossing helical honing marks 13. Prehoning took place with a conventional honing tool having a cutting compound facing of D100 to D200 and led to a peak-to-valley depth $R_K$ of approximately 4 to 6 $\mu$m, whereas the helical honing produced a $R_K$ value of 2.5 to 3 $\mu$m.

Over the helically honed surface is subsequently placed with a further honing operation a honing mark pattern 15, which has honing marks, which are scarcely perceptible and run under an angle between 65 and 75° to the axial direction (crossing angle 30 to 45°).

This sliding honing finishing performed with a small grain size honing coating between D10 and D20, serves to cut off the tips of the surface profile of approximately 1 to 5 $\mu$m and namely in only a relatively few, e.g. ten working strokes. The axial/circumferential speed ratio during machining is approximately between 0.3 and 0.6:1 and working takes place with low contact pressures between 80 and 200 N/cm$^2$, preferably between 120 and 160 N/cm$^2$. The tips are cut off and removed by a true cutting process with limited contact pressure. This differs clearly from so-called friction plating, which uses a high contact pressure and mainly flattens the tips. Thus, during friction plating there is a risk of so-called sheet metal jacket formation leading to the termination of graphite lamellas.

Figure 2:
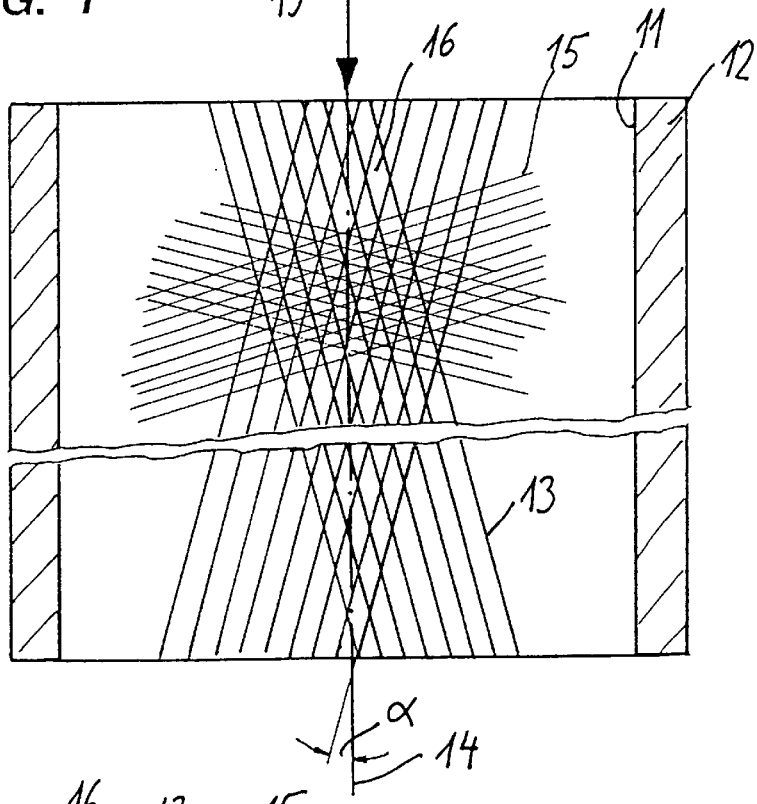
FIG. 2 A greatly superelevated and enlarged section through an internal surface of a honed cylinder.
Figure 2:
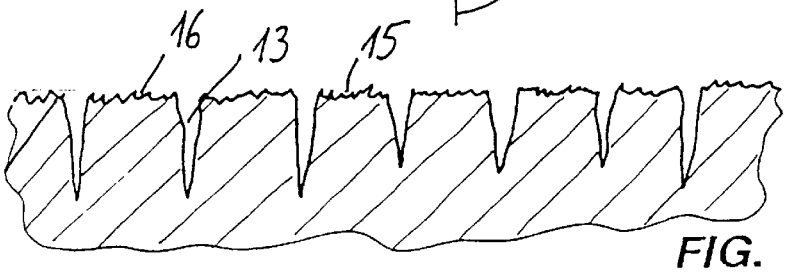

This gives an ideal plateau profile, as shown in FIG. 2. It is pointed out that the production of a plateau has already generally been performed, but in the case of the invention as a result of the honing marks running in the helical direction, plateau formation has a particularly advantageous effect on the usability of the surface as a cylinder internal surface. In said profile it is possible to see the relatively deep helical honing marks 13, which form between them "plateaus" 16, which have a rhombic shape (cf. FIG. 1) with the tips in the axial direction. Within the plateau, by cutting off the previously present tips during finish honing with the fine cutting facing a bearing plateau surface is created, whereas the oil is retained in the intermediate "valleys" 13.

Trial runs with motor vehicle engines have shown that in part the oil consumption could be reduced three to four times and in particular the starting oil consumption for a new engine and also during each starting process was low, so that the strict pollutant standards could be satisfied. It was surprisingly also found that the surface was subject to virtually no changes on running in the engine. Whereas normally, particularly in the vicinity of the upper dead centre, the difference between the surface passed over by the piston and the pure combustion chamber surface after a few trial runs is clearly apparent, in this case scarcely any distinction was visible, which indicates a low wear tendency.

We claim:

1. Method for honing cylinder internal surfaces of cylinders of reciprocating piston-type machines and engines, comprising the steps of:

turning a honing tool with regard to the cylinder; and, axially reciprocating the honing tool with regard to the cylinder, said turning step and said axially reciprocating step in combination performing a honing operation comprising a movement in the cylinder with a low circumferential and a high axial movement component, the high axial movement component being by a factor between 1.5 and 10 greater than the low circumferential component.

2. Method according to claim 1, wherein the axial/circumferential factor is between 2 and 5.

3. Method for honing cylinder internal surfaces of reciprocating piston-type machines and engines, comprising the steps of:

honing finishing the internal surface, said honing finishing step having an axial and a circumferential movement component, the honing finishing axial movement component being by a factor between 0.2 and 1 greater than the honing finishing circumferential movement component; and, honing the internal surface, said honing step after said honing finishing step, said honing step in which a honing tool is turned and axially reciprocated with regard to the cylinder, said honing step having an axial and a circumferential movement component, the honing axial movement component being by a factor between 1.5 and 10 greater than the honing circumferential movement component.

4. Method for honing cylinder internal surfaces of reciprocating piston-type machines and engines, comprising the steps of:

prehoning the internal surface, said prehoning step having an axial and a circumferential movement component, the prehoning axial movement component being by a factor between 0.2 and 1 greater than the prehoning circumferential movement component; and, honing the internal surface, said honing step after said prehoning step, said honing step in which a honing tool is turned and axially reciprocated with regard to the cylinder, said honing step having an axial and a circumferential movement component, the honing axial movement component being by a factor between 1.5 and 10 greater than the honing circumferential movement component.

5. Method for honing cylinder internal surfaces of reciprocating piston-type machines and engines, comprising the steps of:

turning a honing tool with regard to the cylinders; and, axially reciprocating the honing tool with regard to the cylinder, said turning step and said axially reciprocating step in combination performing a honing operation having an axial and a circumferential movement component, the honing operation axial movement component being by a factor between 1.5 and 10 greater than the honing operation circumferential movement component, the honing tool is driven with different axial/circumferential factors during an upward and a downward stroke of its reciprocation.

6. Method for honing cylinder surface of cylinders of reciprocation piston-type machines and engines, comprising the steps of:

turning a honing tool with regard to the cylinders;

axially reciprocating the honing tool with regard to the cylinder, said turning step and said axially reciprocating step in combination performing a honing operation; and, slide honing the surface, said slide honing step following the honing operation, said slide honing operation performed with a hard honing component comprising cutting grains with a grain diameter of 10 $\mu$m to 20 $\mu$m and with a contact pressure below 200 Newton per square centimeters ($N/cm^2$).

7. Method according to claim 6, wherein the contact pressure is between 140 and 160 $N/cm^2$.

* * * * *